United States Patent [19]

Caldwell

[11] Patent Number: 4,676,283

[45] Date of Patent: Jun. 30, 1987

[54] HOME CARBONATION APPARATUS AND METHOD

[76] Inventor: Michael C. Caldwell, 352 N. Caswell, Charlotte, N.C. 28204

[21] Appl. No.: 781,456

[22] Filed: Sep. 30, 1985

[51] Int. Cl.[4] ..... C02D 1/00; B01F 3/04

[52] U.S. Cl. ..... 141/4; 141/7; 141/29; 141/66; 141/98; 99/323.1; 261/DIG. 7; 261/30; 261/64.4; 426/477; 426/397

[58] Field of Search ..... 141/4–7, 141/21–24, 25, 26, 37, 29, 65, 66, 98; 426/477, 395, 397, 118; 261/DIG. 7, 30, 64 C, 8; 99/323.1

[56] References Cited

U.S. PATENT DOCUMENTS

| | | | |
|---|---|---|---|
| Re. 32,142 | 5/1986 | Meyers | 141/4 |
| 3,752,452 | 8/1973 | Jannelli | 261/DIG. 7 X |
| 4,114,659 | 9/1978 | Goldberg et al. | 141/26 |
| 4,482,509 | 11/1984 | Jannelli | 261/DIG. 7 X |
| 4,555,371 | 11/1985 | Jeans | 261/DIG. 7 X |

FOREIGN PATENT DOCUMENTS

| | | | |
|---|---|---|---|
| 824853 | 2/1938 | France | 261/DIG. 7 |
| 1484786 | 9/1977 | United Kingdom | 261/DIG. 7 |
| 2141632 | 1/1985 | United Kingdom | 261/DIG. 7 |

*Primary Examiner*—Stephen Marcus
*Assistant Examiner*—Ernest G. Cusick
*Attorney, Agent, or Firm*—Clifton Ted Hunt

[57] ABSTRACT

An apparatus and method for handling carbon dioxide and excluding it from contact with the atmosphere while carbonating and storage, transfer, and dispensing of the carbonated beverage. The apparatus includes one or two vessels and a valve assembly for each vessel. Each valve assembly has a pressure relief valve and an outlet tap, which are normally closed to isolate the interior of the vessel from the atmosphere, and a pump for transferring and dispensing air and liquid from or to its vessel, all without bringing the carbon dioxide in contact with the atmosphere.

28 Claims, 15 Drawing Figures

HOME CARBONATION APPARATUS AND METHOD

BACKGROUND OF THE INVENTION

The production of soft drink and malt beverages in the home has long been known. Specifically, it is known to produce carbon dioxide by the action of yeast on sugar for making both malt beverages and soft drinks, such as root beer, in the home.

There are several systems presently available for making home beverages which utilize the fermentation and carbonation effected by the action of yeast on sugar but all such systems known to applicant are objectionable from the standpoint of purity and economy. Oxygen is an enemy of fermented and carbonated beverages and none of the prior art systems known to applicant effectively exclude oxygen from such beverages without the use of expensive apparatus.

No prior art system known to applicant can use the carbon dioxide by-product of fermentation of a malt beverage, for example, to carbonate a soft drink without introducding yeast to the recipe of the soft drink. The presence of yeast in a soft drink is undesirable because of taste and because of variances in the carbonation level of soft drinks.

No prior art system known to applicant can accomplish all of the following in the manufacture of a beverage of the type described without at any time subjecting the beverage to atmospheric contact: (1) ferment the beveragwe, (2) capture the carbon dioxide derived from that fermentation for storage and reuse, (3) transfer the fermented beverage at either atmospheric or pressurized condition into a container filled with carbon dioxide and thereby separate the beverage from sediment, (4) carbonate the beverage to desired levels according to selected settings, and (5) dispense a portion of the carbonated beverage without subjecting the beverage remaining in the container to atmospheric contact.

SUMMARY OF THE INVENTION

The present invention utilizes a pressure containment apparatus and method capable of fermenting and carbonating any desired liquid in situ (that is, in the container used by the consumer for convenient refrigerated storage, such as a conventional two-liter bottle).

The prior art need for bottling and capping and the need for capping equipment is thereby avoided. The fermentation and carbonation method and apparatus of this invention utilizes a master valve housing threadably connected to the top of a conventional fixed volume container such as a two-liter bottle. The master valve housing includes an extensible relief valve positioned within a coupling for attachment to a flexible tube, and the coupling extending about the relief valve serves as a passageway for carbon dioxide into and out of the container in selected uses of the carbonating system.

According to the preferred embodiment of the invention, the master valve housing includes a pump, the relief valve, a combination dispensing and filling valve, and a valve block containing passageways selectively establishing communication between the said pump and valves and between the interior of the container on which the master valve housing is mounted. A second master valve housing like the one described is threadably connected to a second container and flexible tubing extends between selected valves in the two housings, depending upon the carbonation or transfer process to be performed.

Alternatively, a single container and its associated valve housing, as described, may be used with a flexible bag positioned in the fixed volume container as described and claimed in my earlier patents, U.S. Pat. No. 4,222,972 issued Sept. 16, 1980 and U.S. Pat. No. 4,343,824 issued Aug. 10, 1982.

It is an object of the invention to provide a mechanism of the type described which is capable of fermenting liquids, carbonating, storing, and dispensing a carbonated liquid without exposing the fermented beverage or carbonated liquid to air until it is dispensed for consumption, while preserving the integrity of the remaining carbonated liquid within the container.

It is another object of the invention to provide an apparatus of the type described utilizing two master valve housings and two containers wherein a first of said containers may be charged with reactive ingredients to produce carbon dioxide and the carbon dioxide be transferred to the second container to carbonate the flavored or unflavored liquid therein, or recarbonate previously carbonated beverages.

A more specific object of the invention is to provide a fermenting and carbonating device utilizing two readily available containers with necks conventionally threaded for the reception of correspondingly threaded caps, and wherein the threaded caps are replaced by correspondingly threaded master valve housings for the purpose of the invention. Reactive ingredients are placed in one container before the master valves are threadably mounted on their respective containers and a liquid to be fermented and carbonated is then introduced into the second container, as by pumping. The master valves of the two containers are then connected by flexible tubing to carbonate the liquid in the second container.

A further object of the invention is to provide a valve assembly specifically adapted for use in carbonating liquids and including inlet and outlet valves, a relief valve, and a manually operable pump. When a liquid is being carbonated in a first container by gas from a second container, the outlet valve of the valve assembly on the second container filled with gas is connected to the inlet valve of the valve assembly on the first container with the liquid. The other components of the two valve assemblies are cooperatively utilized to effectively carbonate and maintain the carbonation of the liquid in the first container until it is dispensed.

A further object of the invention is to provide a means and apparatus for the fermentation of beverages wherein the beverage is contained within the vessel at selected safe pressurization, coincidentally carbonating the beverage as it ferments.

Another object of the invention is to provide an apparatus of the type described wherein the valves of a first vessel containing carbon dioxide are connected to the valves of a second vessel containing a fermented, pressurized beverage. Actuation of the pump on the second or liquid filled vessel causes the beverage to be drawn off of the yeast sediment in the second vessel and into the first vessel where it retains its carbonation.

Another object of the invention is to enable the carbonation of a beverage from a relatively lower pressure carbon dioxide source to a more pressurized carbonating pressure by utilization of the pump.

Similarly, according to the invention, connection of two vessels from the inlet valve of one to the inlet valve of the other, or from the outlet valve of one to the outlet valve of the other, will result in vacuum or pressure transfer, respectively, upon pump actuation for filling or transferring functions while avoiding atmospheric contact with the contents of the vessels.

A further object of the invention is to provide an apparatus of the type described wherein use of a single valve allows the selected repressurization of any vessel containing a carbonated liquid, wherein the carbon dioxide will remain in the liquid as pressure is increased because carbon dioxide is more soluble than air in liquid.

Some of the objects of the invention having been stated, other objects will appear to those skilled in the art from the following description when considered in conjunction with the accompanying drawings.

DETAILED DESCRIPTION OF THE INVENTION

Figure 1:
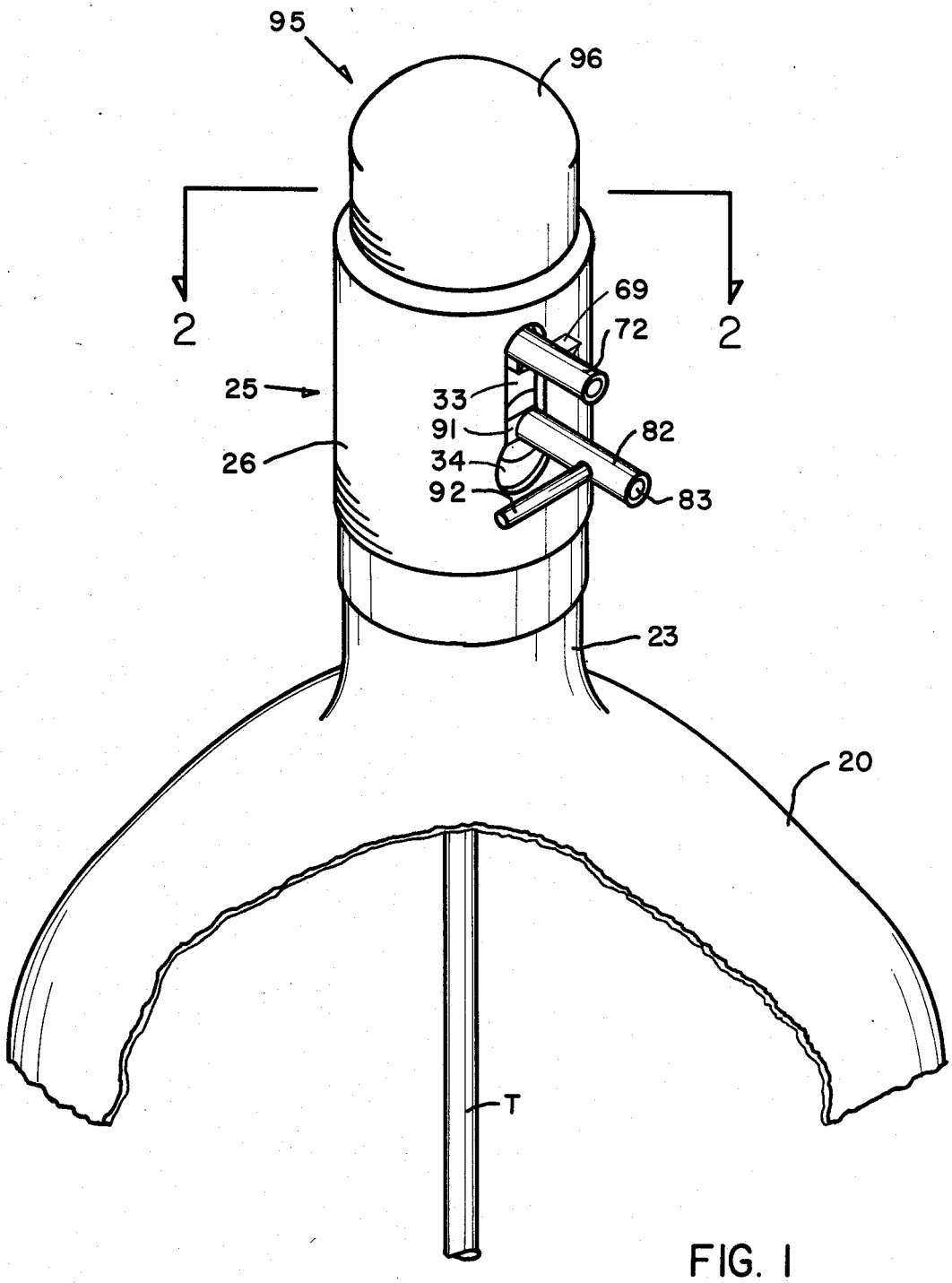
FIG. 1 is a fragmentary perpsective view, with parts broken away, illustrating a container and a master valve housing connected to the top of the container.
Figure 2:
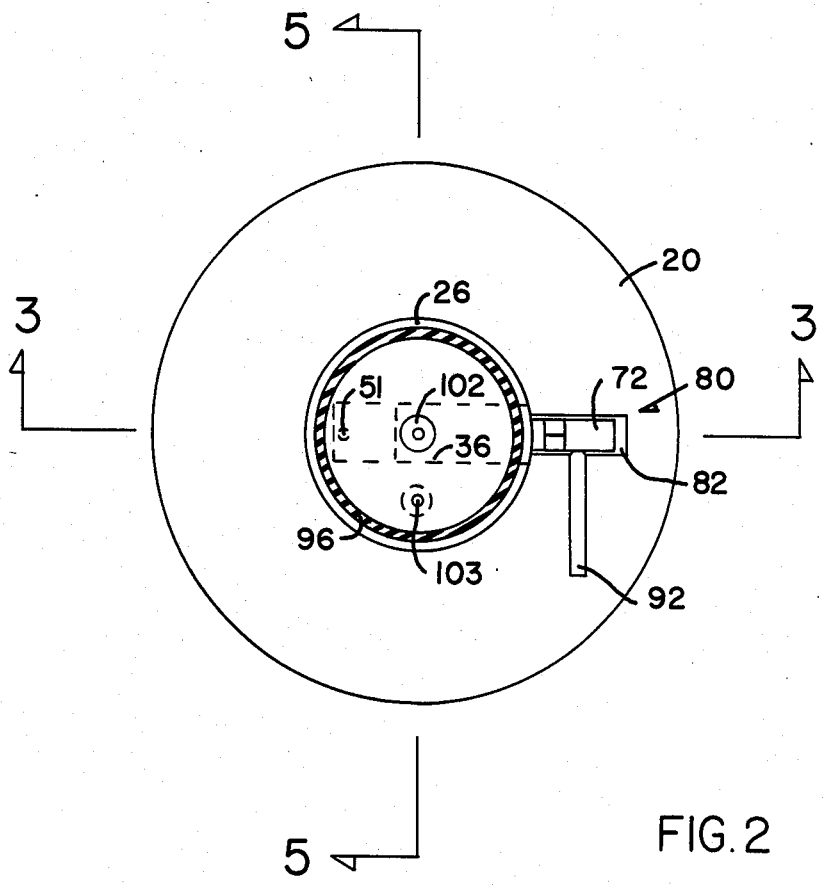
FIG. 2 is a sectional view taken substantially along the line 2—2 in FIG. 1.

Referring more specifically to the drawings, a container 20 includes a boy portion 22 comprising a tubular sidewall and a bottom wall jointed together in a conventional manner. The container 20 also includes the usual reduced neck portion 23 which is exteriorly threaded as at 24 to receive a correspondingly threaded cap (not shown) to enclose the contents of the container 20 from the atmosphere.

According to the invention, the usual cap is replaced by a master valve housing broadly indicated at 25 and comprising a tubular shell or sleeve 26 interiorly threaded as at 27 for threadable engagement with the threads 24 on the neck 23 of container 20.

A valve block or casing 30 is mounted within the tubular shell 26 and is supported thereby. The shell 26 is open at its top and bottom and an inturned annular shoulder 31 extends circumferentially inwardly of the upper end 32 of the shell 26. The side wall of the shell 26 has a vertically elongated opening or slot 33 providing communication between the interior of the shell 26 and the atmosphere and communicating with an enlarged circular opening 34 spaced from the lower edge 35 of shell 26.

The valve block or casing 30 has an upper circular bore 36 registrable with the slot 33 in the shell 26 and a lower circular bore 37 extending in spaced parallel relation to the bore 36 and also registrable with the slot 33. The upper end of valve casing 30 has a reduced shoulder portion 41 terminating in an upper end surface 42. An annular rib 43 extends from the top surface 42 beyond the reduced shoulder portion 41.

The top surface 42 has a central cavity 44 from which an axial passageway 45 extends inwardly providing communication between the top surface 42 of the casing 30 and a reduced medial portion 46 of the upper radial bore 36. The medial portion 46 is defined by a shoulder 47 at its juncture with the rear or inner end of bore 36 in FIG. 3 and by a tapered end portion 48 spaced rearwardly of axial passageway 45 and communicating with a further reduced portion 49 of bore 36. Reduced inner end portion 49 of bore 36 communicates directly but in angular relation with a vertical bore 51 extending in spaced parallel relation to the vertical axis of the valve casing 30 between the reduced inner end portion 49 and the lower end wall 40 of the valve casing 30 for communication with the interior of the assembled container 20 in FIG. 3.

The valve casing 30 has an axial passageway 53 extending downwardly from the lower bore 37 and providing communication with the interior of a downwardly projecting extension 54 of the valve casing 30, to which a tubing T may be attached to extend into the container 20.

THE VALVES

A relief valve assembly 60 is positioned in the upper radial bore 36 in valve casing 30. Valve assembly 60 comprises an elongated valve stem 61 extending through the reduced medial portion 46 of bore 36 and shaped at its inner end portion 62 to define an annular groove 63 for reception of an O-ring 64 adjacent a rearwardly projecting hemispherically shaped valve 65 normally closing the forward end of the reduced inner portion 49 of bore 36. A spring 67 surrounds the valve stem 61 between the inner end portion 62 at the rear of bore 36 and a flange 70 on the inner end of a coupling 72 extending outwardly from the bore 36 and shell 26 through the slot 33. An O-ring 73 extends about the flanged portion 70 of coupling 72.

Figures 6, 7:
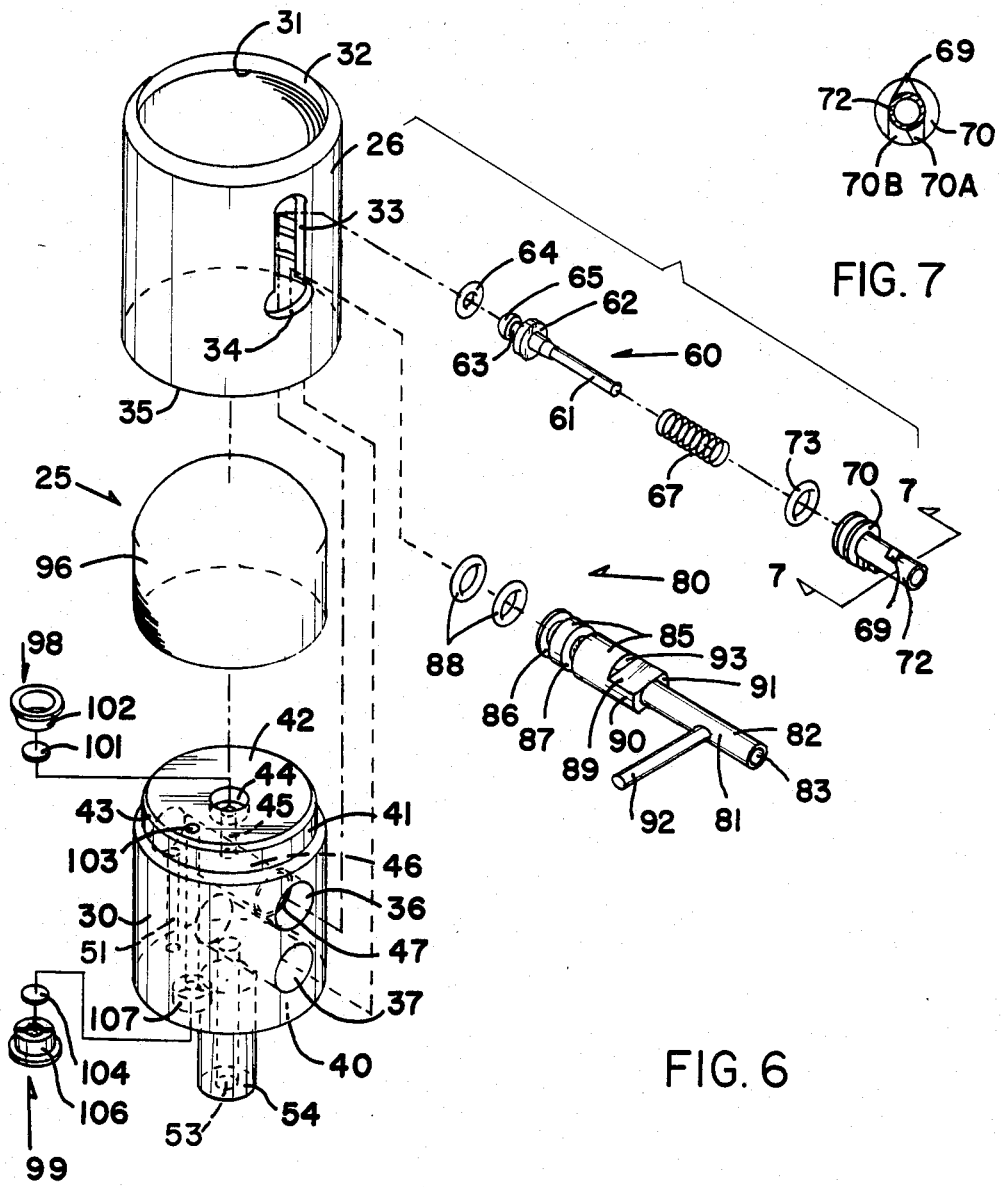
FIG. 6 is an exploded perspective view of a master valve housing illustrating the association of its components.
FIG. 7 is an enlarged sectional view taken substantially along the line 7—7 in FIG. 6.

The relief valve assembly 60 is placed in the bore 36 by first aligning bore 36 in valve casing 30 with the enlarged portion 34 of the vertical opening or slot 33 in tubular shell 26. The valve stem 61 and its inner end portion 62 (which is of larger diameter than the width of slot 33) is passed through the enlarged portion 34 in shell 26 and into the bore 36. The flange 70 on the inner end of coupling 72 is also of larger diameter than the width of slot 33 but of smaller diameter than the bore 36 and enlarged portion 34, and is passed through enlarged portion 34 and seated in bore 36. Flange 70 includes abutments 70A and 70B extending outwardly from flange 70 (FIG. 7) that are selectively engaged with the inner surface of shell 26 adjacent slot 33 to apply a predetermined pressure on the spring 67 to set the amount of pressure required to actuate the relief valve 60.

Figure 13:
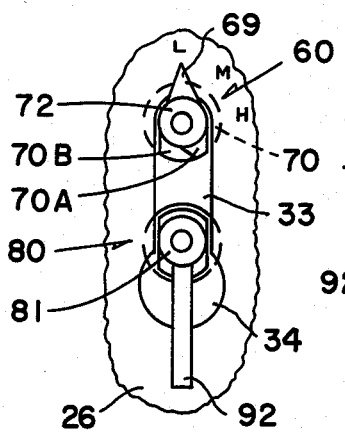
FIGS. 13, 14, and 15 are fragmentary elevations, with parts broken away, of the inlet and outlet valves illustrating different settings for different purposes, such as pressure variation, liquid introduction and dispensing.
Figure 14:
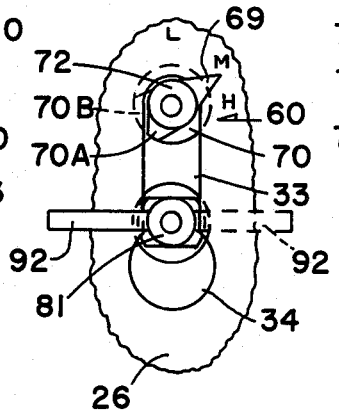
Figure 15:
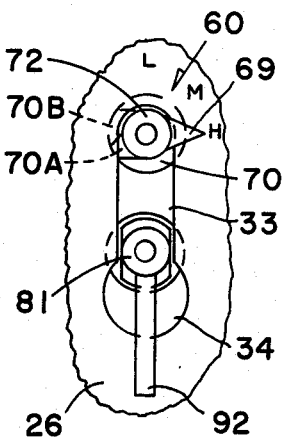

The amount of pressure within container 20 necessary to activate the relief valve assembly 60 is variable according to the amount of compression placed upon the spring 67. An increase in the compression on the spring 67 requires an increase in the pressure in container 20 to move the valve 65 away from the forward end of the reduced bore 49 and establish communication between the interior of the container 20 and the atmosphere. FIGS. 13, 14, and 15 illustrate the setting of the relief valve 60 at its three levels of operation. Valve 60 has an indicator 69 movable in a clockwise direction from a vertical or 12 o'clock position in FIG. 13 to a medial or 1:30 position in FIG. 14, and to a horizontal or 3 o'clock position in FIG. 15. The 12 o'clock position of FIG. 13 represents the lowest pressure setting; the 1:30 position of FIG. 14 represents the medium pressure setting; and the 3 o'clock position of FIG. 15 represents the highest pressure setting of relief valve 60. The desired pressure setting is obtained by first depressing and then rotating the coupling 72 to engage one of the abutments 70A, 70B, or the flange 70 with the inner surface of sleeve 26 adjacent slot 33.

In FIG. 13 the flange 70 engages the shell 26 on container 20 while the abutments 70A and 70B extend through the slot 33. This arrangement reduces the compression on spring 67 (FIG. 4) and correspondingly lowers the amount of pressure required within vessel 20 to overcome the spring and open the relief valve to allow pressure to escape from vessel 20. In FIG. 15 the abutment 70A engages the shell 26 and increased compression is correspondingly applied to the spring 67 to require more pressure within vessel 20 to open the valve. Engagement of abutment 70B with shell 26, as in FIG. 14, requires a moderate or medium amount of pressure to activate the valve.

The downward vertical position of the handle 92 in FIGS. 13 and 15 indicate that the tap 80 is in the open position, while the horizontal positioning of the handle in FIG. 14 shows that the tap is closed and locked. The tap is closed and locked when the handle is moved to a horizontal position on either side of the stem 81.

An outlet valve assembly 80 is positioned within the lower bore 37 of valve casing 30 and comprises a tubular valve stem 81 having an outer end portion 82 and an axial passageway 83 communicating with the atmosphere through the end portion 82 and extending through an enlarged inner end portion 85. The enlarged portion 85 has grooves 86 and 87 extending thereabout for reception of O-rings 88 which sealingly engage the tubular wall of bore 37 and normally seal bore 37 and passageway 83 from communication with the axially extending passageway 53 in valve casing 30. The enlarged portion 85 of valve stem 81 includes opposed flats 89 between shoulders 90 that extend outwardly from valve stem 81 and define abutments 91 (FIG. 6) engagable with the inner surface of shell 26 adjacent slot 33.

Figure 3:
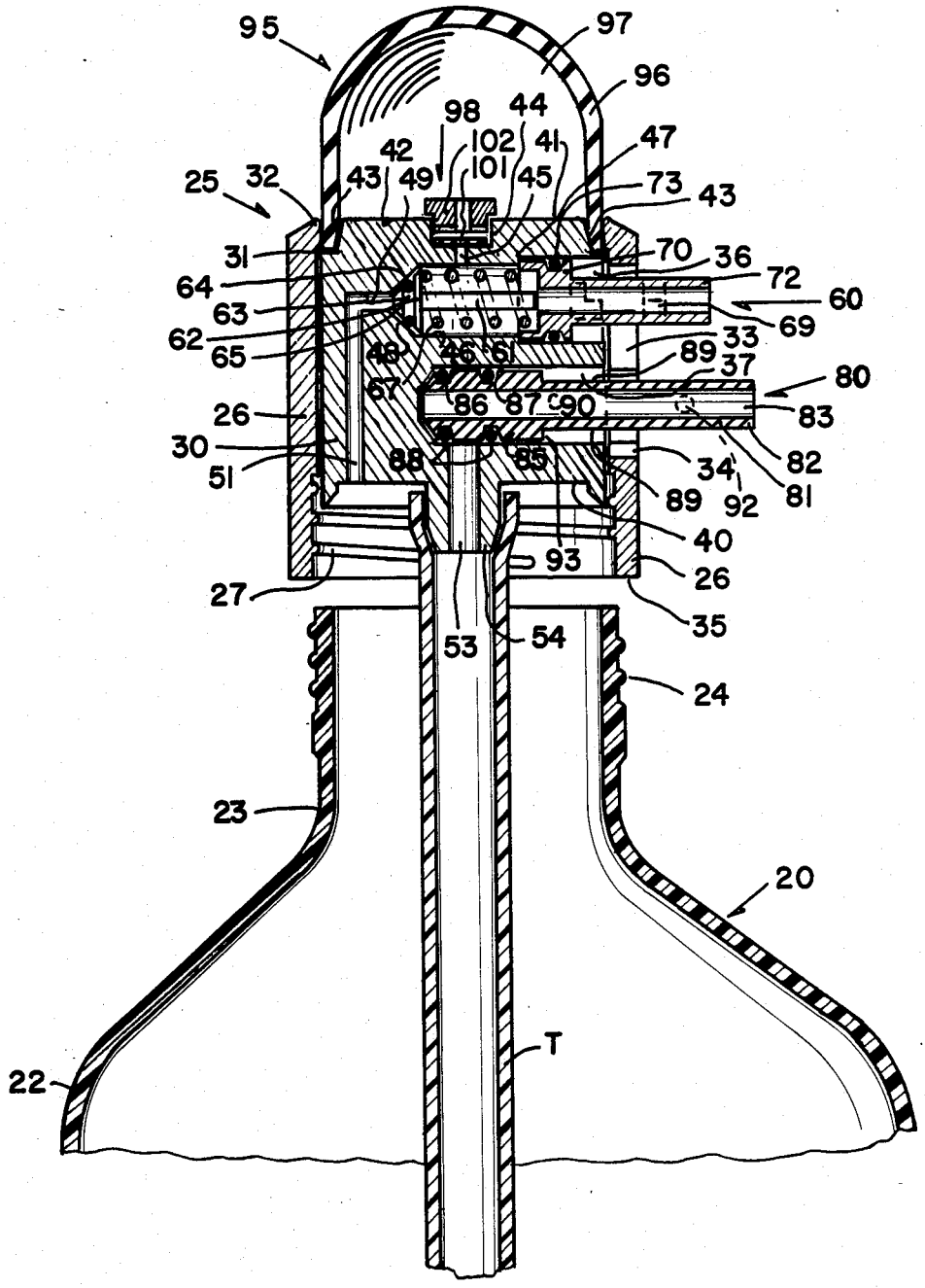
FIG. 3 is an exploded sectional view taken substantially along the line 3—3 in FIG. 2 and showing the outlet valve in closed position and the inlet valve at its highest setting.

The valve assembly 80 is positioned in bore 37 by first affecting relative movement of the shell 26 and valve casing 30 to bring the bore 37 in casing 30 into registry with the enlarged opening 34 in shell 26. The enlarged end portion 85 of valve stem 81 is then passed through the enlarged opening 34 and into bore 37 in casing 30 with the outer end portion 82 of valve stem 81 projecting outwardly through opening 34 in shell 26. The valve casing 30 is then moved upwardly relative to the shell 26, taking its bore 37 out of registry with opening 34 and into registry with slot 33, as best seen in FIG. 1. FIG. 3 shows the valve assembly 80 in its fully closed position, and it is held in that position by engagement of the abutments 91 with the inner surface of shell 26 adjoining slot 33.

A handle 92 projects at right angles from the outer end portion 82 of the valve stem 81, and extends horizontally when the valve 80 is in the closed position of FIG. 3. The handle 92 is rotatable from the closed horizontal position of FIG. 3 to the open vertical position of FIG. 4, and the valve stem 81 with its enlarged portion 85 is rotatable with the handle. Consequently, rotation of the handle causes corresponding rotation of the enlarged portion 85 and its abutments 91, resulting in the abutments 91 being moved out of engagement with the shell 26 and into registry with the slot 33.

Figure 4:
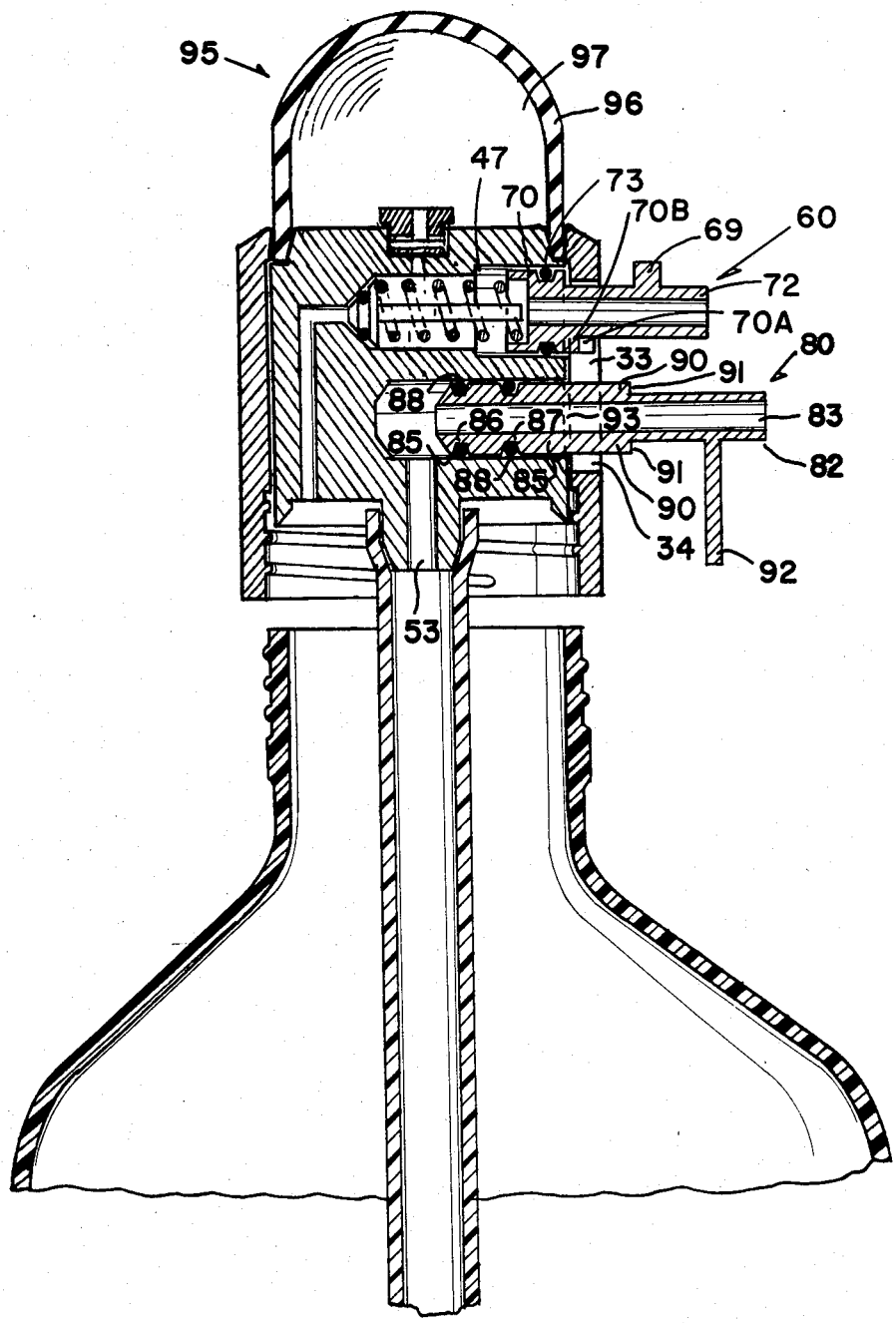
FIG. 4 is a view similar to FIG. 3 but showing the outlet valve in open position and the inlet valve at its lowest setting.

This enables a user to pull outwardly on the handle 92 until the shoulders 90 extend outwardly beyond the shell 26 (FIG. 4) and inner shoulders 93 at the inner ends of flats 89 engage the shell 26 at the marginal edges of slot 33, as shown in FIG. 4. The enlarged portion 85 of valve stem 81 is correspondingly moved outwardly within bore 37 from the closed position of FIG. 3 to the open position of FIG. 4 and thereby establishing communication between the interior of container 20 and the passageway 83 in the valve stem 81. Conversely, the valve assembly 80 may be moved from the open position of FIG. 4 to the closed position of FIG. 3 by first exerting inward pressure on the trigger-like handle 92 to move the enlarged portion 85 and its O-ring 88 in groove 86 inwardly beyond vertical passageway 53 in valve block 30, and then rotating handle 92 to the horizontal closed position of FIG. 3 to engage the abutments 91 with the marginal edges of slot 33, thereby releasably locking the outlet valve assembly 80 in closed position.

THE PUMP

A manual pump, broadly indicated at 95, is actuated by manipulation of a hemispherically shaped piece of soft rubber 96 extending about the top of the valve casing 30 in FIG. 3 and confined between the valve casing 30 and shell 26 by the annular rib 43 at the top of the valve casing 30 and the annular shoulder 31 on the shell 26. The rubber dome 96 encloses a space or pump area 97 above the upper surface 42 of valve casing 30, and either atmospheric air or carbon dioxide gas (depending on whether the coupling 72 is attached to a source of carbon dioxide or is open to the atmosphere) is drawn into the pump area 97 through axial passageway 45 and valve assembly 60.

Air or gas passing upwardly through axial passageway 45 transverses a check valve broadly indicated at 98 and comprising a rubber disc 101 and a check valve retainer 102 within the cavity 44 in the top portion of valve casing 30. Disc 101 seats at the bottom of cavity 44 to prevent backflow of gas from the pump area 97 into the relief valve 60.

Figure 5:
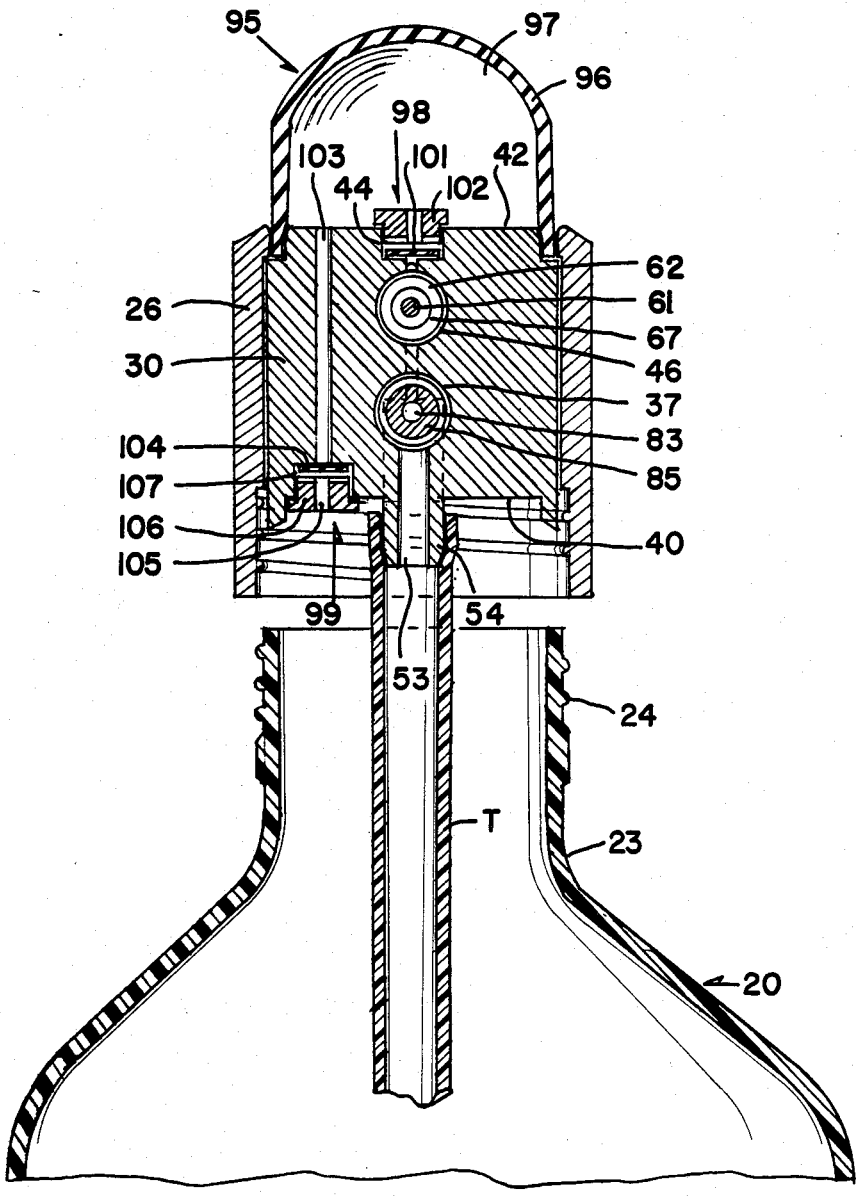
FIG. 5 is an exploded sectional view taken substantially along the line 5—5 in FIG. 2.

Depression of the rubber dome 96 seats the disc 101 in check valve 98 and forces gas from the pump through the passageway 103 (see FIG. 5), past another check valve 99 (comprising a rubber disc 104 and a vent 105 through a check valve retainer 106 seated in cavity 107 in the bottom wall 40 of valve casing 30) and into container 20. When the dome 96 is released and permitted to return to its normal elevated position, as shown in FIG. 3, gas is drawn into the interior of the pump through the check valve 98, the passageway 36, and the coupling 72 connected as by flexible tubing 111 to a source of carbon dioxide gas or atmospheric air.

OPERATION

FIGS. 8 through 12 illustrate the use of two containers, 20 and 20A, each equipped with its own master valve assembly 25 and 25A, respectively, and each structured as previously described.

The purpose of using two containers, each equipped with a master valve assembly of this invention, is to provide a convenient, reliable, and effective means of transferring carbon dioxide from one container to a second container without atmospheric contact for any one of several functions, including carbonating a liquid within the second container, storing the carbon dioxide in the second container, transferring a liquid in the second container to the first container, or dispensing liquid from the second container for consumption or for other use outside the containers.

Atmospheric air, and particularly its oxygen is contamination in carbonated beverages. Oxygen changes the flavor of many beverages and accelerates deterioration of the beverage by light and heat; and encourages the growth of certain types of undesirable microorganisms.

It is inevitable that oxygen will be in the containers 20 and 20A at the beginning of a carbonating operation. It will be present as part of the atmosphere when the valve assemblies 25 and 25A are installed. It may be entrapped in the water or syrup put in one or both containers before carbonation.

The valve assemblies 25 and 25A, when used in accordance with the invention, purge the air and its oxygen from the containers during carbonation and keep it out of the beverage until dispensed for consumption or other use. Advantage is taken of these facts:

1. Fermentation of three (3) grams of yeast in a sugar solution comprising four (4) ounces (112 grams) of sugar and one (1) liter of water produces approximately sixteen (16) liters of carbon dioxide.

2. The carbonation level of soft drinks and beer generally ranges between two (2) and five (5) volumes at seventy degrees (70) Fahrenheit temperature (21 degrees Celsius) and five (5) to thirty-seven (37) pounds (16.7 kilograms) of pressure per square inch.

3. The production rate of carbon dioxide decreases as the temperature decreases below the optimum temperature of approximately sixty (60) degrees Fahrenheit (16 degrees Celsius).

4. The rate of carbonation increases as the temperature is lowered.

5. The rate of carbonation increases with increase of the pressure in the carbonating container or generator.

6. Carbon dioxide is 50 times more soluble in water or carbonated beverages than the gasses that comprise the atmosphere.

7. Carbon dioxide is one and one-half times as heavy as air. Consequently, the air moves to the head space on top of the beverage as it carbonates.

Valve assembly 25 is specifically structured for use in the production of carbon dioxide as a by-product of fermentation and to utilize the foregoing physical properties and law to produce good carbonated beverages which are not at any time contaminated by contact with the atmosphere until dispensed for consumption.

More specifically, some beverages require more carbonation than others (in general, soft drinks require more than beer) and a container equipped with the valve assembly 25 can be used to provide the requisite carbonation pressure to any beverage. In the preferred embodiment, the spring 67 in relief valve 60 is of a predetermined compression strength sufficient to cooperate with the flange 70 and abutments 70A and 70B to require pressures within container 20 of either 5 (flange 70), 26 (abutment 70B), or 37 (abutment 70A) pounds per square inch to activate the relief valve.

These pressures have been selected as preferred because they can be used to get a wide range of carbonation by adjustment of the pressure setting (flange 70 and abutments 70A and 70B) to correspond with the temperature of the carbonating beverage and the desired level of carbonation in the finished product.

The preset pressures of 5, 26, and 37 pounds can be changed as desired by changing the strength of spring 67 and the length of abutments 70A and 70B.

Figure 8:
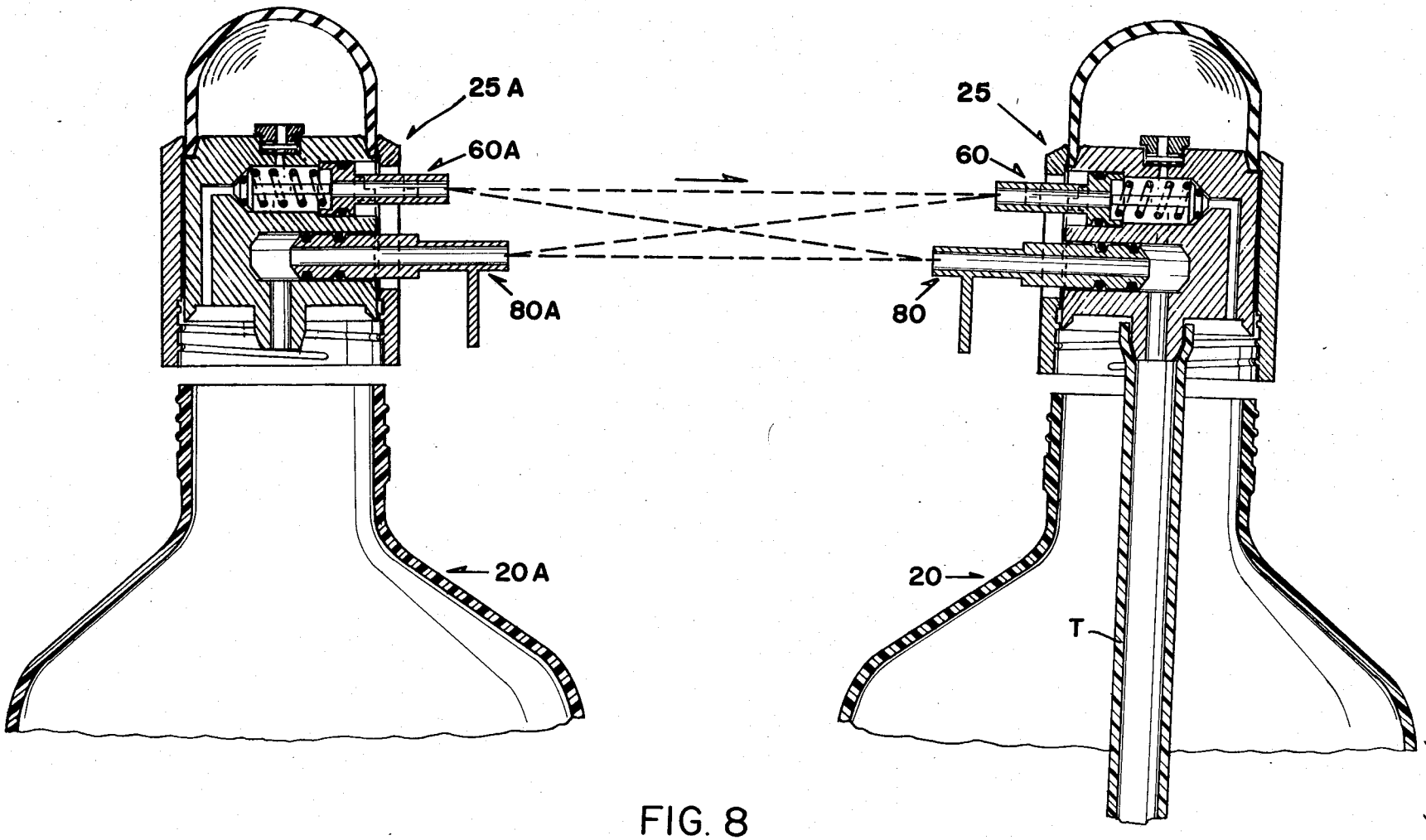
FIG. 8 is a sectional view similar to FIG. 3 but showing two containers, each equipped with a master valve housing for the fermentation and carbonation of a liquid according to the invention and illustrating in phantom lines a tubing connection between the containers.

In FIG. 8, reagents for production of carbon dioxide are placed in container 20A and carbon dioxide is thereby produced in that container (sometimes referred to as a vessel). A liquid which may be plain water or a desired flavor of soft drink or beer is placed in a second vessel indicated at 20. Note that the tube T extends into the liquid from the valve casing 30 in the second vessel 20 but the tube T has been removed from the generating vessel 20A to prevent transfer of sediment or the liquid portion of the reagents from the first vessel into the second vessel. It is intended that only carbon dioxide gas be transferred from the first vessel to the second vessel in this instance.

The transfer of carbon dioxide gas from the first vessel to the second vessel may be accomplished by any of the several ways schematically illustrated in FIG. 8. The dotted lines extending between the valves 60A, 80A and 60, 80 represent plastic tubing. Briefly, one end of tubing may be connected to either valve 60A or 80A and the other end of that tube be connected to either valve 60 or valve 80 to transfer carbon dioxide from the first vessel 20A to the second vessel 20. Pressure setting selection on the relief valve 60 will determine the carbonation level imparted to the contents of the second vessel 20.

Figure 9:
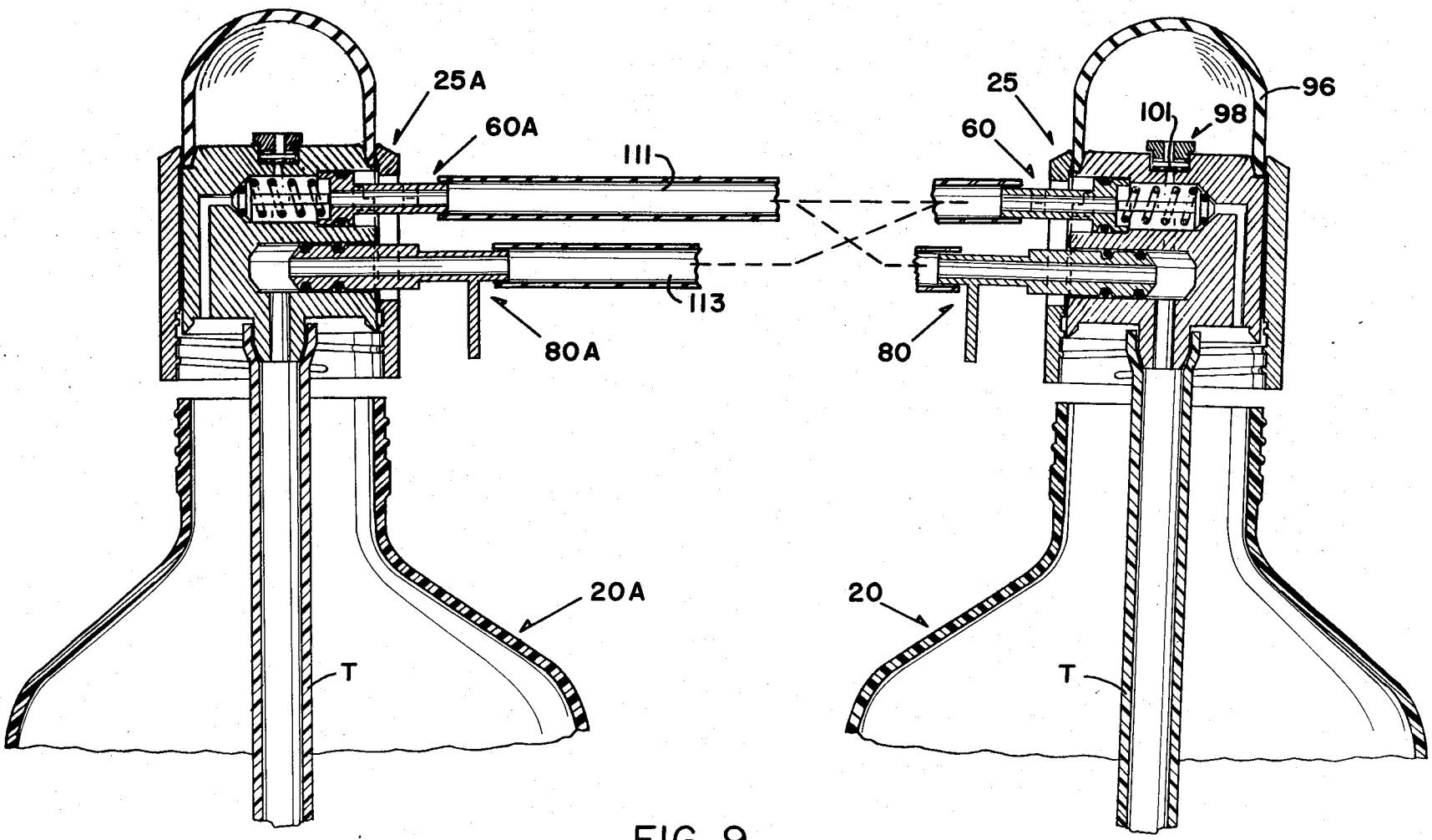
FIGS. 9, 10, 11, and 12 are sectional views similar to FIG. 8 and illustrating other connections of valves on different containers for purposes of the invention.

FIG. 9 illustrates an arrangement of two vessels for capturing carbon dioxide from vessel 20A for storage in vessel 20, and FIG. 9 also illustrates methods of dispensing.

It is important that atmospheric air be evacuated from an empty container (vessel 20) before filling it with a carbonated beverage from the first container 20A. The evacuation of air from the second container 20 is accomplished by extending tubing between the relief valve 60A to the tap 80 of the empty second container 20. Because carbon dioxide is one and one-half (1½) times as heavy as air the carbon dioxide entering vessel 20 will first settle to the bottom and move all the air outwardly through the relief valve 60 as the vessel fills with carbon dioxide. Some of the carbon dioxide will also escape after the selected pressure is reached.

Assuming now that a fermenting beverage is initially within the first vessel 20A and that water or a beverage is within the second vessel 20, and assuming it is desired to transfer carbon dioxide gas from the first vessel 20A to the second vessel 20 for the purpose of capturing and storing the carbon dioxide or dispensing a beverage from the second vessel 20, tubing 111 is used to connect relief valve 60A with relief valve 60, both of the relief valves being adjusted to their minimum setting. Actuation of the pump 96 on the second vessel 20 will then draw in carbon dioxide gas from vessel 20A past the inlet check valve 98 and outlet check valve 99 (FIG. 5) of vessel 20 and into the container 20. As the pressure within the second vessel 20 increases, the carbonated liquid will be forced upwardly through the tube T and may be withdrawn from the tap 80 by opening it. Liquid may thus be expelled for the capture and storage of carbon dioxide within vessel 20.

Assuming now that the first container 20A contains only the reagents for forming carbon dioxide gas, the tube T is removed from within the first container 20A and the plastic tubing 111 is removed from the relief valves 60A and 60. Instead, tubing 113 extends from tap 80A to relief valve 60 and pump 96 on the second vessel 20 is actuated to draw carbon dioxide gas from the first vessel into the second vessel 20. The increase in pressure within the second vessel 20 causes the carbonated liquid to rise through tube T and outwardly through tap 80 as heretofore. The second container 20 fills with carbon dioxide as the liquid is drawn off through the tap 80 and the carbon dioxide may be used again for any of the purposes explained herein. At no time has the carbon dioxide gas or the liquid contacted the atmosphere until the liquid is withdrawn from the second container through its tap 80. The integrity of the gas and liquid are thereby maintained in a manner not previously possible.

Figure 10:
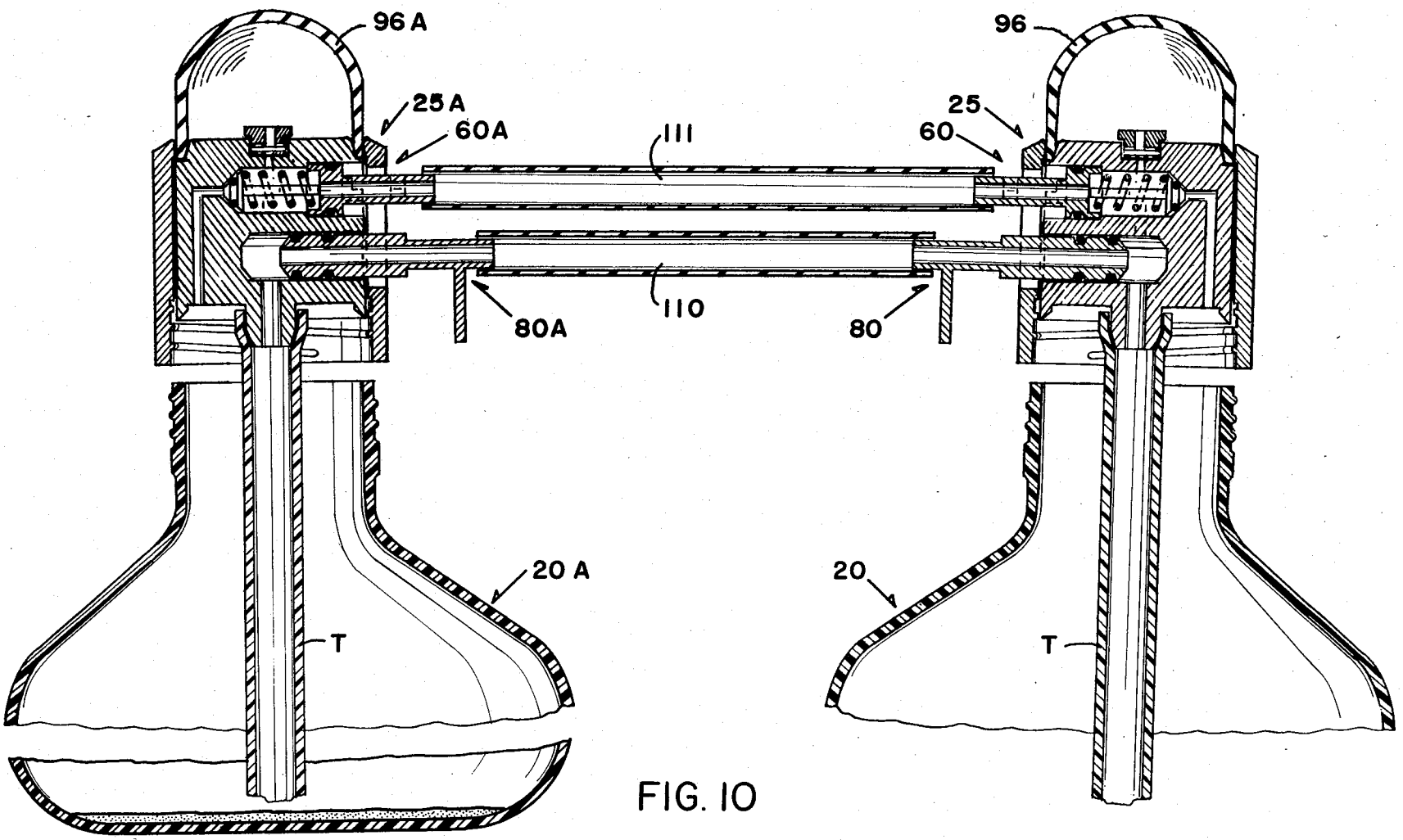

FIG. 10 illustrates the transfer of a carbonated liquid from the first vessel 20A to the second vessel 20. The intended purpose is to transfer a fully carbonated beverage from one vessel to another without atmospheric contact or loss of carbonation. In the illustration of FIG. 10 this is accomplished by providing the first vessel 20A with feremented carbonated beverage and providing the second vessel 20 with equally pressurized carbon dioxide gas. Tubing 110 is connected to the tap 80A on the first vessel and to the tap 80 on the second vessel and tubing 111 is connected to relief valve 60A on the first vessel and to relief valve 60 on the second vessel. The relief valve 60A remains set at the equalization pressure and valve 60 is subsequently set for a lower pressure to facilitate the transfer. The two taps 80 and 80A are then opened to establish communication between the two vessels.

Bearing in mind that the carbon dioxide pressure in the second vessel 20 is equal to the carbon dioxide pressure in the first liquid filled vessel 20A, it is clear that actuation of pump 96A on the first vessel will create additional pressure in the first vessel sufficient to force the carbonated liquid upwardly within the tube T and outwardly through the tap 80A, the tubing 110 and inwardly through the tap 80 and downwardly through the tube T in the second container 20. The amount of pressure in the two containers was equal at the beginning of the operation and remains equal as the operation proceeds with the transfer of carbon dioxide from the second vessel 20 through its relief valve 60, tubing 111 and inwardly through the relief valve 60A of the first vessel 20A while liquid is transferred from first vessel 20A to second vessel 20 through respective taps 80A andd 80 through tubing 110 in response to actuation of the pump 96A. It is noted that in FIG. 10 the lower end of tubing T within the first vessel 20A terminates above the reagents for producing carbon dioxide so that the sediment from fermentation stays in the first vessel 20A.

It is necessary to actuate the pump on the first vessel 20A to start the transfer and it will probably be necessary to actuate the pump to complete the transfer, but it is not necessary to continually actuate the pump during the transfer because of the tendency of the pressure to equalize within the vessels. After sufficient pressure has built up in the first vessel to cause a transfer of the liquid, the liquid will continue flowing from the first vessel to the second vessel while the carbon dioxide flows from the second vessel to the first vessel until the pressure is equalized. At that point the pump is again actuated to increase the pressure in the first vessel and the process is repeated until the transfer is completed.

After completion of the transfer, the valves 80 and 80A are closed and the relief valve 60, which had been adjusted to a lower setting than relief valve 60A during the transfer, is reset to the appropriate higher setting to maintain the desired pressure in the second vessel 20 before removal of the tubing 110 and 111. Carbonated beverage from the first vessel is thus transferred to the second vessel 20 while the sediment from fermentation stays in the first vessel 20A with the carbon dioxide transferred to it from the second vessel 20. The carbon dioxide then in the first vessel 20A may be used to carbonate a beverage in a third vessel.

Figure 11:
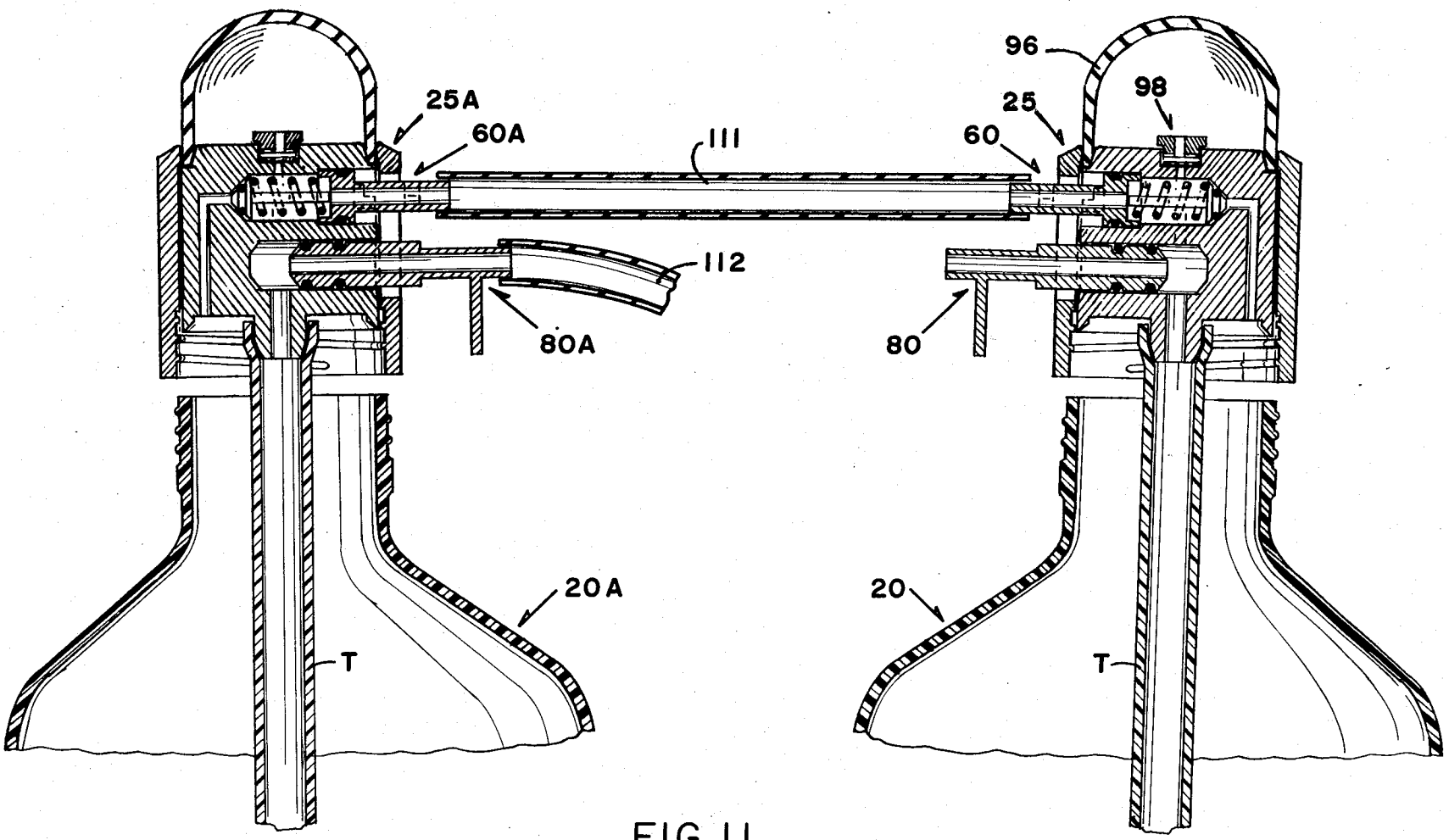

FIG. 11 illustrates the vacuum filling of a vessel or the recovery of carbon dioxide for other functions such as carbonating another beverage, or dispensing a beverage from another container, or repressurizing another container.

In the arrangement of FIG. 11, the first vessel 20A is initially full of pressurized carbon dioxide and the second vessel 20 is initially full of a liquid. To fill the first vessel 20A with liquid from a third vessel or other source of liquid, a tube 112 is extended from said other source of liquid to the tap 80A of the first vessel. Relief valve 60A is then set at its lowest pressure and a tube 111 is connected to the relief valves 60 and 60A of the two vessels. Pump 96 on the second vessel 20 is then actuated to draw carbon dioxide from the first vessel 20A through the tubing 111, through the inlet check valve 98 and then downwardly past the outlet check valve 99 and into the second container 20 (See FIG. 5). The transfer of carbon dioxide from the first vessel 20A carbonates the liquid in the second vessel 20 and reduces the pressure within the first vessel which, when lower than atmospheric pressure, is replenished by liquid drawn from a source through tube 112 and tap 80A.

The arrangement of FIG. 11 enables the first vessel to be filled with a liquid to be fermented or carbonated while excluding atmosphere from contact with the liquid. Meanwhile, the carbon dioxide initially in the first vessel 20A is recovered in the second vessel 20 for such reuse as may be desired.

Figure 12:
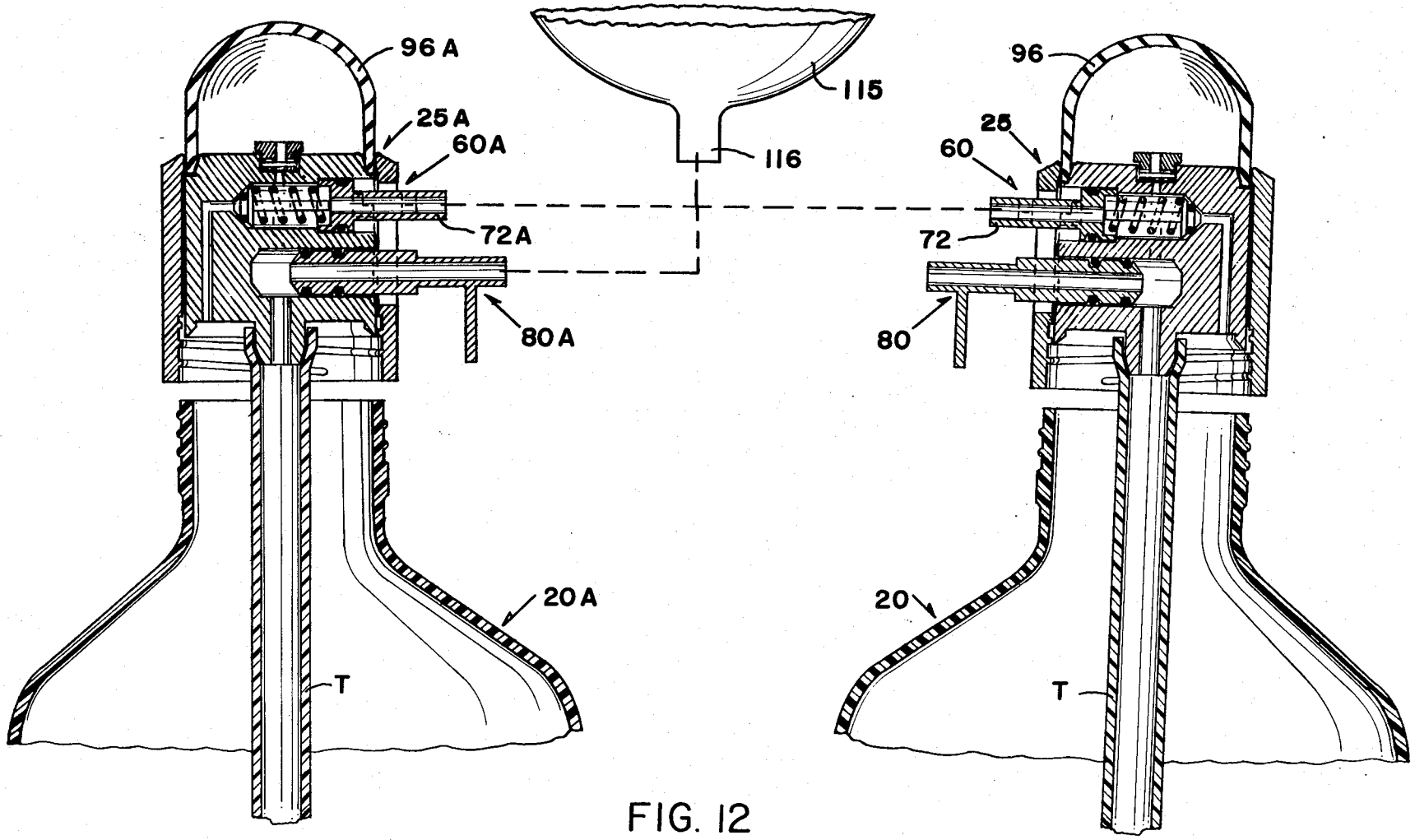

FIG. 12 illustrates the use of two containers with an external collector for the transfer and storage of carbon dioxide. The first vessel 20A contains a fermenting beverage or reactive agents for the generation of carbon dioxide gas. The second vessel 20 contains a liquid, and an external collector in the form of a flexible bag or balloon 115 is empty. Carbon dioxide gas is transferred from the first vessel 20A to the collector 115 by attaching a neck 116 on the collector 115 to either the relief valve 60A or the tap 80A (with tubing T removed) of the first vessel 20A. Carbon dioxide gas is transferred from first vessel 20A to external collector 115 as it is produced for collection and storage in the collector 115. Carbon dioxide gas may be stored within collector 115 and the neck 116 of collector 115 may, when desired, be attached to a container 20 through its relief valve 60 and may be used for any purpose such as carbonating or dispensing.

It is sometimes desirable to lower the dispensing pressure upon a carbonated liquid dispensed through tap 80 of a container because too much pressure on the liquid may result in loss of carbonation as carbon dioxide is dispensed from the beverage. The excess pressure may be removed from the container by attaching an external collector 115 to the relief valve outlet 72 of the container and adjusting the pressure on the relief valve to its lowest setting. Subsequent repressurization after dispensing is made through actuation of pump bulb 96 and appropriate pressure setting.

There is thus provided a novel and useful apparatus and method for home carbonation of beverages, and although specific terms have been used in the description they are used in a descriptive sense only and not for purpose of limitation.

I claim:

1. A method of handling the transfer of carbon dioxide in isolation from the atmosphere between the interiors of two vessels which are closed against the atmosphere, said method comprising the steps of:

(a) providing carbon dioxide in a first vessel, (b) providing first and second openings communicating with the interior of a first vessel and normally closed against the atmosphere, (c) providing a pressure relief valve adjustable to open at a selected pressure in said first opening, (d) providing a normally closed outlet tap in the second opening, (e) providing first and second openings communicating with the interior of a second vessel and normally closed against the atmosphere, (f) providing a pressure relief valve adjustable to open at a selected pressure in the first opening of said second vessel, (g) providing a normally closed outlet tap (80) in the second opening of said second vessel, (h) providing a pump communicating with the interiors of both vessels, and (i) adjusting the pressure relief valves to be activated at selected pressures, connecting the valves and taps to provide communication between the two vessels, opening the taps, and activating the pump, all as desired to perform a selected function in the handling of carbon dioxide without exposing it to the atmosphere.

2. A method according to claim 1 including carbonating beverages comprising the steps of:

(a) placing reactive ingredients for forming carbon dioxide in the first vessel, (b) placing a liquid in the second vessel, (c) establishing communication between the interiors of the two vessels while excluding the atmosphere, whereby carbon dioxide generated by the reactive ingredients in the first vessel will move into and carbonate the liquid in the second vessel.

3. A method according to claim 2 wherein the first vessel contains a fermenting beverage.

4. A method according to claim 1 including exchanging a beverage in one vessel for carbon dioxide in a second vessel comprising the steps of:

(a) providing a fermenting beverage in the first vessel, (b) providing carbon dioxide gas in the second vessel at a pressure at least equal to the pressure in the first vessel, (c) and then increasing the pressure in the first vessel above the pressure in the second vessel to force the carbonated beverage from the first vessel to the second vessel and replace it with carbon dioxide from the second vessel.

5. A method according to claim 1 including isolating beverages from the atmosphere during carbonation comprising the steps of:

(a) the carbon dioxide in the first vessel is at a selected pressure, (b) a liquid is provided in the second vessel at a lower pressure than the said selected pressure in the first vessel, and (c) carbon dioxide is transferred from the first vesel to the second vessel in isolation from the atmosphere.

6. A method according to claim 5 wherein the carbon dioxide in the first vessel is generated by reactive ingredients in the first vessel.

7. A method according to claim 5 wherein the carbon dioxide in the first vessel is provided by fermenting a beverage in the first container.

8. A method according to claim 5 wherein the liquid in the second vessel is carbonated by the carbon dioxide transferred from the first vessel.

9. A method according to claim 5 which includes the additional steps of:

(a) opening the outlet tap (80) of the second vessel, (b) and dispensing liquid from the second vessel in response to the increase of pressure in the second vessel because of the transfer of carbon dioxide in isolation from the atmosphere.

10. A method according to claim 1 including carbonating and maintaining beverages in isolation from the atmosphere comprising the steps of:

(a) providing carbon dioxide at a selected pressure in the first vessel, (b) providing a liquid in the second vessel at a pressure at least as high as the pressure in the first vessel, (c) establishing communication between the interiors of the two vessels in isolation from the atmosphere, and (d) activating the pump to draw carbon dioxide from the first vessel into the second vessel.

11. A method according to claim 10 wherein the pump communicates with the interiors of the two vessels through their respective pressure relief valves.

12. A method according to claim 10 wherein the pump communicates with the interiors of the two vessels through the relief valve (60) of the second vessel (20) and the open outlet tap (80A) of the first vessel (20A).

13. A method according to claim 10 wherein the pump communicates with the interiors of the first and second vessels (20A and 20) through their respective open outlet taps (80A and 80).

14. A method according to claim 1 including exchanging a carbonated beverage in a first vessel for carbon dioxide in a second vessel comprising the steps of:

(a) providing a fermented beverage carbonated to a selected pressure in the first vessel, (b) providing carbon dioxide in the second vessel at a pressure equal to the pressure in the first vessel, (c) establishing direct communication between the inlet valves (60A and 60) in isolation from the atmosphere, (d) establishing direct communication between the outlet taps (80A and 80) in isolation from the atmosphere,
(e) opening the outlet taps on both vessels,
(f) adjusting the relief valve (60) on the second vessel to its lowest pressure setting,
(g) adjusting the relief valve (60A) on the first vessel to a selected pressure setting, and
(h) activating the pump to draw carbon dioxide from the second vessel through the inlet valves (60 and 60A) to the interior of the first vessel (20) while transferring the fermented carbonated beverage from the first vessel (20A) through the outlet taps (80A and 80) to the interior of the second vessel (20) until the beverage is in the second vessel and the carbon dioxide is in the first vessel to complete the exchange.

15. A method according to claim 1 including transferring a fermented or carbonated beverage from a first vessel to a second vessel while filling the first container with liquid from an external source and while isolating the contents of both vessels and of the external source from the atmosphere, said method comprising the steps of:
(a) providing a fermented and carbonated beverage at a selected pressure in the first vessel,
(b) adjusting the relief valve (60A) of the first vessel to its lowest pressure setting,
(c) connecting the inlet valves (60A and 60) of both vessels together in isolation from the atmosphere,
(d) opening the normally closed outlet tap (80A) of the first vessel,
(e) providing an external source of liquid,
(f) activating the pump to draw carbon dioxide from the first vessel through the inlet valves (60A and 60) on both vessels and into the second vessel while vacuum filling the first vessel with liquid from the external source through the open tap of the first vessel,
(g) closing the outlet tap of the first vessel after the first vessel is filled with liquid from the external source, and
(h) adjusting the relief valve of the first vessel to a higher selected pressure setting, whereby the liquid drawn into the first vessel may be fermented and the carbon dioxide drawn into the second vessel may be used to carbonate another beverage.

16. A method according to claim 1 including capturing carbon dioxide gas for storage and subsequent reuse said method comprising the steps of:
(a) providing a fermented beverage carbonated to a selected pressure in the first vessel (20A),
(b) providing direct communication between the outlet tap (80A) and the beverage in the first vessel,
(c) providing a liquid in the second vessel (20),
(d) adjusting the relief valve of the first vessel to a selected pressure setting,
(e) adjusting the relief valve of the second vessel to a lower pressure setting,
(f) providing direct communication between the relief valves (60A and 60) of the first and second vessels,
(g) opening the normally closed tap (80) of the second vessel, and
(h) activating the pump to draw carbon dioxide from the first vessel into the second vessel while dispensing liquid from the second vessel, all without exposing the carbon dioxide to the atmosphere.

17. A method according to claim 1 including collecting carbon dioxide from a first vessel for storage in an external collector and delivering the carbon dioxide in the external collector to a second vessel while isolating the carbon dioxide from the atmosphere, said method comprising the steps of:
(a) providing a source of carbon dioxide and carbon dioxide gas at a selected pressure in the first vessel,
(b) providing an external collector that is closable to isolate its interior from the atmosphere,
(c) providing direct communication between the interior of the first vessel and the interior of the external collector through one of the openings of the first vessel,
(d) collecting pressurized carbon dioxide from the first vessel into the external collector,
(e) removing the connection between the first vessel and the external collector,
(f) sealing the external collector from communication with the atmosphere,
(g) storing the carbon dioxide in the external collector,
(h) providing communication between the interior of the second vessel and the external collector through one of the openings of the second vessel, and
(i) activating the pump to transfer carbon dioxide from the external collector into the second vessel, all without exposure of the carbon dioxide to the atmosphere.

18. A valve assembly for use in the carbonation of beverages, said valve assembly comprising:
(a) means for airtight connection to a container,
(b) a tap,
(c) means for moving the tap between a closed airtight position sealing the interior of the container from the atmosphere and an open position providing communication between the interior of the container and selectively with the atmosphere or with another container,
(d) a normally closed relief valve,
(e) means establishing communication between the relief valve and the interior of the container,
(f) means providing communication of the relief valve selectively with the atmosphere or with another container,
(g) means for adjusting the responsiveness of the relief valve to pressure within the container,
(h) a pump, and
(i) means providing communication of the interior of the container through the pump selectively with the atmosphere or with another container.

19. A valve assembly according to claim 18 wherein a check valve is provided between the pump and the inlet valve preventing movement of air from the pump outwardly through the inlet valve.

20. A valve assembly according to claim 18 wherein a check valve is provided between the pump and the interior of the container for preventing movement of air from the container outwardly through the pump.

21. A valve assembly for controlling the flow of gas and liquid into and out of a vessel while isolating the interior of the vessel and its contents from the atmosphere, said valve assembly comprising:
(a) a tubular shell including means for airtight connection to a vessel and having an elongated slot terminating in spaced relation from the ends of the tubular shell, (b) a valve block mounted within the tubular shell and supported thereby,
(c) said valve block having passageways therein normally providing communication between the atmosphere and the interior of the vessel to which the valve assembly is attached,
(d) a combination pressure relief and inlet valve in one of said passageways and normally closing that passageway from communication between the atmosphere and the interior of the vessel,
(e) an outlet tap in a second of said passageways normally closing the second passageway from communication between the atmosphere and the interior of the vessel,
(f) a pump comprising a resilient hollow hemisphere extending beyond the valve casing and connected thereto in an airtight manner,
(g) selected passageways in said valve casing providing communication between the interior of the pump and the interior of the vessel,
(h) a check valve preventing movement of gas and liquid outwardly from the vessel through the pump,
(i) a check valve between the relief valve and the interior of the container preventing movement of gas and liquid outwardly from the pump through the combination relief and inlet valve,
(j) means for adjusting compression of the spring in the relief valve to change the amount of pressure required in the vessel to activate the relief valve,
(k) and means for opening the outlet tap to dispense the contents of the container without admitting atmospheric air into the container.

22. A valve assembly according to claim 21 wherein said means for adjusting compression of the spring comprise abutments of different lengths selectively engagable with the tubular shell to provide predetermined compression of the spring.

23. A valve assembly according to claim 21 wherein said means for opening the outlet tap to dispense the contents of the vessel without admitting atmospheric air into the vessel comprises a tube extending from the inner end of the outlet tap within the container to a point beneath the liquid level in the vessel.

24. A method of transferring carbon dioxide in a first vessel to an external collector and for subsequently transferring the carbon dioxide in the exteral collector to a second vessel while the carbon dioxide is at all times during the transfer process isolated from the atmosphere, said method comprising the steps of:
(a) providing a source of carbon dioxide and carbon dioxide gas at a selected pressure in the first vessel,
(b) providing an external collector that is closable to isolate its interior from the atmosphere,
(c) providing direct communication between the interior of the first vessel and the interior of the external collector,
(d) transferring carbon dioxide from the first vessel into the external collector,
(e) sealing the external collector from communication with the first vessel and from communication with the atmosphere,
(f) providing a pump communicating with the interior of the external collector and with the interior of the second vessel, which is otherwise closed against the atmosphere, and
(g) activating the pump to transfer carbon dioxide from the external collector into the second vessel, all without exposure of the carbon dioxide to the atmosphere.

25. A method according to claim 24 including the additional step of sealing the interior of said second vessel from communication with the atmosphere to retain the carbon dioxide in the second vessel.

26. Apparatus for the handling of carbon dioxide to carbonate a liquid while excluding the atmosphere from contact with the carbon dioxide and the liquid, said apparatus comprising:
(a) a first vessel,
(b) means for providing carbon dioxide in the first vessel,
(c) means for isolating the interior of the first vessel and its carbon dioxide from the atmosphere,
(d) a second vessel containing a liquid and closed against the atmosphere,
(e) an external collector closed against the atmosphere,
(f) means for transferring carbon dioxide from the first vessel to the external collector,
(g) means for transferring carbon dioxide under pressure from the external collector to the second vessel to carbonate the liquid in the second vessel, and
(h) a check valve in the second vessel allowing carbon dioxide to enter the second vessel but preventing its escape.

27. Apparatus according to claim 26 wherein said means for transferring carbon dioxide under pressure from the external collector to the second vessel is a pump communicatively connected between the external collector and the second vessel.

28. Apparatus for the handling of carbon dioxide to carbonate beverages while excluding the atmosphere from contact with the carbon dioxide, said apparatus comprising:
(a) a first vessel,
(b) reactive ingredients for generating carbon dioxide in the first vessel,
(c) means for isolating the interior of the first vessel from the atmosphere,
(d) a second vessel closed against the atmosphere,
(e) a valve assembly for each of said first and second vessels,
(f) each of said valve assemblies having first and second openings communicating with the interior of its respective vessel and normally closed against communication with the atmosphere,
(g) a pressure relief valve in said first opening,
(h) means for adjusting the pressure relief valve to open at a selected pressure and thereby provide communication between the interior of the vessel and the atmosphere,
(i) a normally closed outlet tap in the second opening of each valve assembly,
(j) a pump,
(k) means providing communication between the pump and the interior of each vessel,
(l) means selectively connecting the relief valves and outlet taps of the two valve assemblies to provide communication between the two vessels,
(m) means for adjusting the pressure relief valves to be activated at selected pressures within their respective vessels,
(n) means for opening the outlet taps,
(o) and means for activating the pump, all without admitting atmosphere to the carbon dioxide.

* * * * *